US010626601B2

(12) United States Patent
Gosling

(10) Patent No.: US 10,626,601 B2
(45) Date of Patent: Apr. 21, 2020

(54) ANGLED WALL CONNECTOR BRACKET

(71) Applicant: DIRTT Environmental Solutions Ltd., Calgary (CA)

(72) Inventor: Geoff Gosling, Calgary (CA)

(73) Assignee: DIRTT Environmental Solutions, Ltd., Calgary (CA)

( * ) Notice: Subject to any disclaimer, the term of this patent is extended or adjusted under 35 U.S.C. 154(b) by 0 days.

(21) Appl. No.: 15/741,375

(22) PCT Filed: Jun. 8, 2017

(86) PCT No.: PCT/US2017/036511

§ 371 (c)(1),
(2) Date: Jan. 2, 2018

(87) PCT Pub. No.: WO2017/214371

PCT Pub. Date: Dec. 14, 2017

(65) Prior Publication Data

US 2019/0003178 A1 Jan. 3, 2019

Related U.S. Application Data

(60) Provisional application No. 62/348,512, filed on Jun. 10, 2016.

(51) Int. Cl.
*E04B 2/74* (2006.01)
*E04B 1/38* (2006.01)

(52) U.S. Cl.
CPC ..... *E04B 2/7425* (2013.01); *E04B 2/7438* (2013.01); *E04B 2001/405* (2013.01); *E04B 2002/7446* (2013.01)

(58) Field of Classification Search
CPC ..... E04B 2/7425; E04B 2/7438; E04B 2002/7446

(Continued)

(56) References Cited

U.S. PATENT DOCUMENTS 2,321,671 A * 6/1943 La Grotta ..... E04B 2/7854 52/242
2,737,268 A * 3/1956 Smith ..... E04G 5/00 403/21

(Continued)

FOREIGN PATENT DOCUMENTS

EP 0213381 A2 * 3/1987 ..... E04B 2/7442
WO 2014/200765 A1 12/2014

OTHER PUBLICATIONS

International Search Report and Written Opinion dated Aug. 17, 2017 from International Patent Application No. PCT/US2017/036511.

(Continued)

*Primary Examiner* — Patrick J Maestri
*Assistant Examiner* — Joseph J. Sadlon
(74) *Attorney, Agent, or Firm* — Workman Nydegger

(57) ABSTRACT

A connector bracket is used to connect a second wall module to a first wall module at an intermediate position between opposing sides of the first wall module. The connector bracket can include a first connector plate, having one or more tabs extending therefrom, that connects to a vertical bracket of the second wall module and a second connector plate that connects to a horizontal support member of the first wall module. The connector bracket can additionally include a transition plate connected between the first connector plate and the second connector plate. The connector bracket can allow for the two wall modules to be connected together at right angles, obtuse angles, or acute angles, depending on the orientation and/or configuration of the connector bracket, the second connector bracket, and/or the transition bracket.

20 Claims, 8 Drawing Sheets

(58) Field of Classification Search
USPC ..... 52/239
See application file for complete search history.

(56) References Cited

U.S. PATENT DOCUMENTS 3,486,287 A * 12/1969 Guillon ..... E04B 2/78 52/239
3,534,517 A * 10/1970 Kann ..... A47B 57/54 52/239
3,837,128 A * 9/1974 O'Brien ..... E04B 2/766 52/127.11
4,100,709 A * 7/1978 Good ..... E04B 2/7427 160/135
4,113,109 A * 9/1978 Donnelli ..... A47F 5/0823 206/806
4,263,764 A * 4/1981 Wendt ..... E04B 2/789 52/481.2
4,462,196 A * 7/1984 Freiberg ..... E04B 2/7401 52/122.1
4,508,300 A * 4/1985 Minick ..... A47B 57/30 160/135
4,567,698 A * 2/1986 Morrison ..... A47B 83/001 160/135
4,637,178 A * 1/1987 Nimmo ..... E04B 2/7438 160/135
RE32,890 E * 3/1989 DeFouw ..... A47B 83/001 52/239
4,947,601 A * 8/1990 McGuire ..... E04B 2/7425 52/239
5,528,875 A * 6/1996 Ziegler, Jr. ..... A63B 9/00 403/231
5,816,001 A * 10/1998 Goodman ..... A47B 57/425 52/239
5,943,834 A * 8/1999 Jeffers ..... E04B 2/7425 160/351
6,068,041 A 5/2000 Miles et al.
6,126,358 A * 10/2000 Waits ..... E04B 2/7425 403/231
6,158,179 A * 12/2000 Ackerly ..... E04B 2/745 52/126.3
6,167,664 B1 * 1/2001 Reuter ..... E04B 2/7425 160/351
6,173,547 B1 * 1/2001 Lipson ..... E04B 2/7425 52/239
6,186,469 B1 * 2/2001 Scott ..... B28B 19/0061 249/16
6,261,026 B1 * 7/2001 Conley ..... F16B 5/0685 16/252
6,332,295 B1 * 12/2001 Spielhoff ..... F16B 5/0685 16/252
6,615,559 B2 * 9/2003 McGrath ..... E04B 2/7411 52/289
6,634,824 B2 * 10/2003 Liu ..... E04B 2/7433 403/170
6,684,929 B2 * 2/2004 MacDonald ..... E04B 2/7425 160/135
6,691,380 B2 * 2/2004 Vassiliou ..... F16B 5/0614 24/289
6,807,776 B2 * 10/2004 Girdwood ..... A47B 83/001 160/130
7,024,833 B1 * 4/2006 Rice ..... E04B 2/8647 52/426
7,429,023 B2 * 9/2008 Morrow ..... E04B 1/003 248/200
7,832,154 B2 * 11/2010 Gosling ..... E04B 2/7425 160/135
8,046,962 B2 * 11/2011 Glick ..... E04B 1/41 52/404.1
8,074,415 B2 * 12/2011 Terada ..... E04B 1/41
8,371,460 B2 * 2/2013 Ghatikar ..... E04B 2/7854 52/242
8,661,765 B2 * 3/2014 Schaefer ..... A47B 96/14 52/655.1
9,032,681 B1 * 5/2015 Brady ..... E04B 1/41 52/404.1
9,822,524 B1 * 11/2017 Meznarich ..... F16M 13/02
9,896,840 B2 * 2/2018 Ting ..... E04B 1/41
9,976,301 B2 * 5/2018 Loffler ..... E04G 5/00 403/21
10,273,681 B2 * 4/2019 Lammer-Klupazek ..... E04F 13/0805
2001/0025460 A1 * 10/2001 Auer ..... E04B 2/744 52/282.2
2005/0056749 A1 * 3/2005 Simard ..... A47B 57/34 248/248
2006/0236625 A1 * 10/2006 MacDonald ..... E04B 2/7425 52/239
2008/0104907 A1 * 5/2008 Glick ..... E04B 2/7425 52/239
2008/0104922 A1 5/2008 Glick et al.
2011/0068242 A1 3/2011 Eberlein et al.
2012/0042593 A1 * 2/2012 Glick ..... E04B 2/7425 52/300

OTHER PUBLICATIONS

International Preliminary Report on Patentability dated Dec. 20, 2018 from International Patent Application No. PCT/US2017/036511.

* cited by examiner

ANGLED WALL CONNECTOR BRACKET

CROSS-REFERENCE TO RELATED APPLICATIONS

The present invention is a 35 U.S.C. § 371 U.S. National Stage of PCT Application No. PCT/US2017/036511, filed Jun. 8, 2017, which claims the benefit of U.S. Patent Application No. 62/348,512, filed on Jun. 10, 2016, and entitled ANGLED WALL CONNECTOR BRACKET, the entire content of which is incorporated herein by reference.

BACKGROUND

Technical Field

This disclosure relates to systems, methods, and apparatus for modular wall construction and design. More specifically, this disclosure relates to brackets that enable wall modules to be connected together at various locations and/or angles.

Background and Relevant Art

Wall systems, or dividers as they are sometimes called, are commonly used in an office environment to separate work areas and to give people privacy where permanent walls are lacking, undesirable, or impractical. Such wall systems are typically formed of multiple wall modules that are connected together to define or separate individual spaces (e.g., rooms, offices, etc.). The ends of the wall modules are connected together along their vertical edges. Being able to connect wall modules together only at their corresponding ends can limit the number of options available for configuring the wall modules into spaces of different sizes and shapes.

BRIEF SUMMARY

Implementations of the present disclosure comprise systems, methods, and apparatus that enable construction of modular walls. In particular, implementations of the present invention comprise wall modules having a connector bracket associated therewith and which enables the construction of modular walls by connecting wall modules together at locations other than at corresponding ends of the wall modules. For example, a first wall module associated with a connector bracket provided herein can permit the first wall module to be joined at a right angle (or a non-right angle) to a second wall module at a position between the ends of the second wall module, thereby forming a modular wall.

In at least one implementation, a connector bracket is provided for use in connecting two wall modules together. The connector bracket includes a first connector plate having one or more tabs extending therefrom for connecting to a first wall module. The connector bracket can also include one or more second connector plates for connecting to a second wall module. The connector bracket can also include a transition plate that is connected between the first connector plate and the one or more second connector plates.

In some implementations, the first connector plate and the one or more second connector plates extend from the transition plate in opposite directions and/or from opposing sides of the first connector plate. Additionally, or alternatively, the two tabs extend from opposing ends of the first connector plate.

In some implementations, the first connector plate and the transition plate are oriented at a 90° angle relative to one another. Additionally, or alternatively, the one or more second connector plates and the transition plate are oriented at a 90° angle relative to one another. In some implementations, the transition plate extends from the first connector plate at a non-right angle and/or the one or more second connector plates extend from the transition plate at a non-right angle.

In some implementations, the one or more second connector plates comprise two second connector plates. In some implementations, each of the two second connector plates comprises one or more openings configured to receive a fastener. The one or more openings in a first, second connector plate are, in some implementations, offset from the one or more openings in a second, second connector plate. Additionally, or alternatively, each of the two second connector plates comprise one or more access openings, and in some implementations, the one or more access openings in a first, second connector plate are offset from the one or more access openings in a second, connector plate. Additionally, or alternatively, at least one of the access openings in one of the second connector plates is aligned with an opening in the other of the second connector plates.

In another example implementation, a modular wall system includes a first wall module, a second wall module, and a connector bracket. The first wall module includes one or more vertical brackets and one or more horizontal support members connected to the one or more vertical brackets. The second wall module includes one or more vertical brackets and one or more horizontal support members connected to the one or more vertical brackets. At least one of the vertical brackets of the second wall module includes a channel therein. The connector bracket is configured to connect the first wall module and the second wall module together and can include (i) a first connector plate configured to be received within the channel of the second wall module and (ii) a second connector plate configured to be connected to the one or more horizontal support members of the first wall module.

In some implementations, the connector bracket of the modular wall system can include a transition plate that is connected between the first connector plate and the second connector plate. In some implementations, the first connector plate and the transition plate are oriented at a 90° angle relative to one another. Additionally, or alternatively, the second connector plate and the transition plate are oriented at a 90° angle relative to one another. In some implementations, the transition plate extends from the first connector plate at a non-right angle and/or the second connector plate extends from the transition plate at a non-right angle.

Additional features and advantages of illustrative and/or exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such illustrative and/or exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific implementations and/or implementations thereof which are illustrated in the appended drawings. Understanding that these drawings depict only typical implementations and/or implementations of the invention and are not therefore to be considered to be limiting of its scope, the invention will be described and explained with additional specificity and detail through the use of the accompanying drawings in which.

DETAILED DESCRIPTION

Figure 1:
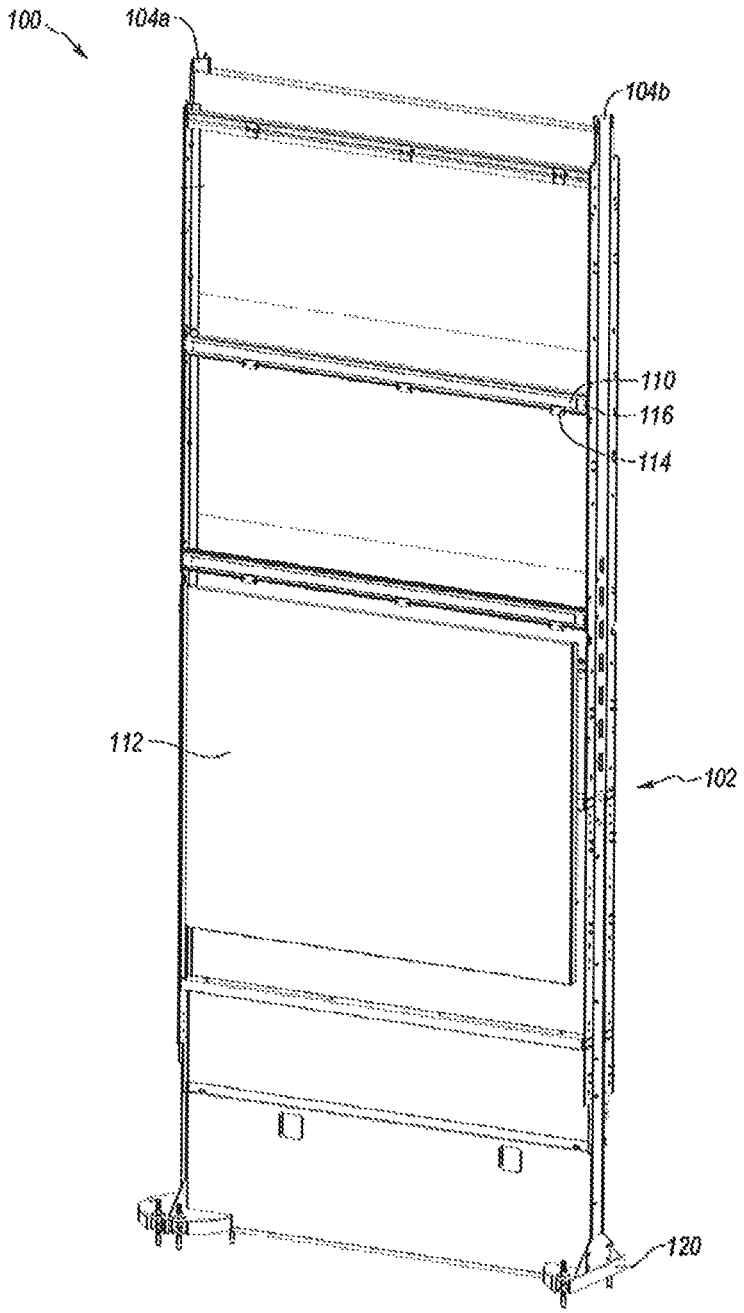
FIG. 1 illustrates an exemplary wall module in accordance with one or more implementations of the present disclosure.

The present invention extends to systems, methods, and apparatus that enable construction of modular walls. In particular, implementations of the present invention comprise wall modules having a connector bracket associated therewith and which enables the construction of modular walls by connecting wall modules together at locations other than at corresponding ends of the wall modules. For example, a first wall module associated with a connector bracket provided herein can permit the first wall module to be joined at a right angle (or a non-right angle) to a second wall module at a position between the ends of the second wall module, thereby forming a modular wall.

Modular wall systems are particularly useful in dynamic environments such as offices, schools, and other mixed-use areas. Their adaptability for a multitude of uses is what makes them an invaluable tool. In these environments it is likely that modular wall users would intend to use these modular walls as they are accustomed to using traditional walls. These uses include using the wall as a means of separating or defining a workspace or to increase privacy. Because traditional walls are custom built for the given space, they can be particularly sized and shaped for a given purpose. Modular walls, on the other hand, include prefabricated wall modules that are assembled end to end to create what is generally a rough estimation of the desired shape or contour. Even if the wall modules are of varying sizes, being able to connect wall modules together only at their corresponding ends can limit the number of options available for configuring the wall modules into spaces of different sizes and shapes.

Implementations of the present disclosure include systems, methods, and apparatuses that enable wall modules to be connected together at various locations and/or angles—not just at their corresponding ends. For example, a connector bracket is provided for use in connecting first and second wall modules together at any position along a first wall module. The exemplary connector bracket includes a first connector plate that adjustably associates with a vertical frame member of the second wall module, and a second connector plate of the exemplary connector bracket is then coupled to a desired position along a horizontal bracket of the first wall module. The first and second wall modules are now connected together, and the angle at which they connect can be right angle (e.g., 90°) or it can be a non-right angle (e.g., an acute or obtuse angle). This is advantageous because this enables customization of modular walls beyond that which was previously capable. By implementing one or more connector brackets disclosed herein, modular wall systems can be better tailored to a particular size and/or shape-similar to a traditional wall yet without the disadvantages of permanence, high cost, and immutability that come along with being a traditional wall. That is, in some implementations, the disclosed connector brackets increase the versatility of modular wall systems and provide a low-cost alternative to constructing and/or remodeling interior spaces.

For example, implementations of the present disclosure enable modular wall systems that can create more dynamic modular walls and spaces defined thereby. As an exemplary illustration of the foregoing, a central modular wall and partitions a room along a first direction by assembling wall modules end-to-end. One or more additional spaces can be defined in a direction transverse to the central modular wall by adding one or more wall modules at a junction (e.g., the corresponding ends) of two wall modules of the central modular wall. However, these types of connections are limited to taking place at ends of wall modules. By associating a connector bracket with a wall module, this wall module can now be placed at any position along the central modular wall. For example, the wall module having a connector bracket can be positioned in the middle of a wall module comprising the central modular wall.

Additionally, the connector brackets provided herein allow for the connection of wall modules at a traditional 90° angle to one another or at a non-right angle with respect to the two modular walls and/or a floor/ceiling. These additional options provide versatility to modular wall systems, and due to the ease by which the connector brackets can be implemented within a modular wall, different sizes, styles, and/or angular relationships between wall modules are quickly and easily interchanged.

Referring now to the figures, FIG. 1 illustrates a wall module 100 including a frame 102 according to an implementation of the present disclosure. In particular, FIG. 1 illustrates one or more sides of wall module 100 during installation. One will appreciate that the opposing side (not shown) can comprise essentially the same components, but need not be identical in construction (e.g., number of frame and/or wall elements) on both opposing sides of wall module 100. As illustrated, frame 102 includes opposing first and second vertical brackets 104*a*, 104*b*. One will appreciate, however, that the present disclosure is not limited to a frame including two vertical brackets. For instance, a frame according to certain implementations may include a single vertical bracket or more than two vertical brackets depending on the specific structural and/or aesthetic needs of the user.

In certain implementations, frame 102 and/or vertical brackets 104*a*, 104*b* may be formed of or otherwise comprise metal or a metal alloy. In other implementations, however, frame 102 and/or vertical brackets 104*a*, 104*b* may be formed of or otherwise comprise any suitable material, known in the art or otherwise, which can be used to construct, build, or assemble such wall modules.

Frame 102 may also include base elements 120 configured to support frame 102 in a substantially vertical position. In other implementations, however, base element 120 may be configured to support the frame 102 in any suitable orientation, direction, and/or position, including substantially horizontal or diagonal. As illustrated, base element 120 is attached to frame 102 at the bottom of each vertical bracket 104*a*, 104*b*, and is configured for attachment to a floor or subfloor member (not shown). In other implementations, however, base element 102 may be attached to any portion of frame 102 and/or wall module 100. Base element 102 may also be configured for attachment to a ceiling, wall, pillar, divide, or any other suitable structure, or may be configured to stand alone without attachment to other structural element(s). Furthermore, base element 120 may include a single base element, or a plurality of base elements or subunits as illustrated.

Wall module 100 may further include a plurality of wall elements. In some implementations, the plurality of wall elements includes at least one exterior wall element 112. In certain implementations, exterior wall element 112 is configured to substantially conceal from view at least a portion of frame 102, vertical brackets 104*a*, 104*b*, and/or some of the plurality of wall elements (e.g., horizontal support members 110), from a first vantage point. An exterior wall element 112 may include a single sheet, tile, or board configured to cover a defined area. However, the exterior wall element may additionally, or alternatively, include a plurality of subunits that are assembled together into an exterior wall element or other wall exterior. A plurality of exterior wall elements is also contemplated herein. Furthermore, in some implementations, an exterior wall element may include and/or be formed of any material suitable for construction, fabrication, and/or installation on a modular wall according to implementations of the present disclosure.

In some implementations, the exterior wall element may include an aesthetic display or appearance. For example, an exterior wall element may include an outer surface that provides structural and/or aesthetic appeal suitable for a residential, commercial, industrial, governmental, educational, and/or other building or environment. Furthermore, in some implementations, the outer surface of an exterior wall element may function as an outer or exterior surface of a wall, divide, barrier, or other architectural and/or decorative structural element.

In at least one implementation, the plurality of wall elements further includes at least one horizontal support member 110. In some implementations, horizontal support member 110 is configured to at least partially secure the exterior wall element 112 to the frame 102. As illustrated, horizontal support member 110 may include at least one elongated bar, strip, column, or other element configured for attachment to at least one of vertical brackets 104*a*, 104*b*. In certain implementations, however, horizontal support member 110 may include a clip, plate, bracket, screw, bolt, tie, adhesive, fastener, or any other material suitable for securing an exterior wall element 112 to the frame 102. Furthermore, a plurality of horizontal support members 110 configured to at least partially secure one or more exterior wall elements 112 to one or more frames 102 and/or one or more vertical brackets 104 is also contemplated herein.

In one or more implementations, the horizontal support member 110 is attached to vertical brackets 104*a*, 104*b*, and exterior wall element 112 is attached to a horizontal support member 110 so as to substantially conceal from view at least a portion of frame 102, the vertical brackets 104*a*, 104*b*, and/or one or more of the plurality of wall elements (including horizontal support member 110) from at least a first vantage point. The exterior wall element 112 may be attached to a horizontal support member 110 via an attachment member 114.

One will appreciate, however, that the present disclosure is not so limited. For instance, the horizontal support member 110 can additionally, or alternatively, be attached to vertical brackets 104*a*, 104*b*, and the exterior wall element 112 may additionally, or alternatively, be attached to frame 102 and/or vertical brackets 104*a*, 104*b*. Furthermore, the exterior wall element 112 can be attached to a horizontal support member 110 directly, through an attachment mechanism involving slotted and/or interlocking attachment members, frictional and/or gravitational forces, or any other suitable mechanism of direct attachment. Exterior wall element 112 may additionally, or alternatively, be attached to horizontal support member 110 indirectly via at least one attachment mechanism.

As used herein, the term "attachment mechanism" includes any device in one or more pieces that may be used to "attach" two or more components or to "attach" one component to another component. The term "attach" and/or "attachment" may refer to its common dictionary definition where appropriate, but it may contextually refer to particular acts of connecting, associating, affixing, fastening, sticking, joining, or any combination of the foregoing that cause an object to be fixedly or selectively proximate another object. In some implementations, the attachment mechanism may be an integral part of a component, whereas in other implementations, the attachment mechanism may be separate.

An attachment mechanism is to be understood to have any number of movable and/or fixed parts, any of which may singularly or in combination with one or more components interact to facilitate attachment. As non-limiting examples, an attachment mechanism may include a mechanism for attaching components using one or more—or a combination of—chemical adhesives (e.g., an epoxy and/or other thermosetting adhesives, glue, cement, paste, tape and/or other pressure-sensitive adhesives, etc.), mechanical fasteners (e.g., threaded fasteners such as a combination of a threaded rod together with a complementary threaded nut, rivets, screw, clamp, buckle, tenon and mortise pairs, cable ties, rubber bands, etc.), magnets, vacuums (e.g., suction cups, etc.), and/or interference fittings (e.g., press fittings, friction fittings, etc.). Additionally or alternatively, an attachment mechanism may include any material or element resulting from physically attaching two or more components by crimping, welding, and/or soldering.

As shown in FIG. 1, the horizontal support member 110 may be attached to frame 102 and/or vertical brackets 104*a*, 104*b* via one or more fasteners 116. The fastener 116 may include a bolt, screw, rivet, or other attachment mechanism configured to secured two elements together by passing into and/or through both elements. One will appreciate, however, that a fastener 116 according to the present disclosure is not so limited. For instance, a fastener 116 may additionally, or alternatively, include a clip, bracket, tie, adhesive, fastening member, or any other material suitable for securing and/or attaching a horizontal support member 110 to frame 102. Furthermore, fastener 116 may attach horizontal support member 110 to frame 102 by any suitable mechanism.

In some implementations, horizontal support member 110 comprises a first end and a second end. As illustrated, the first end of the horizontal support member 110 may be attached to the first vertical bracket 104*a* and the second end of the horizontal support member 110 may be attached to the second vertical bracket 104*b*. One will appreciate, however, that the present invention is not so limited and that horizontal support member 110 may be attached to frame 102 by or through any suitable mechanism.

Figure 2:
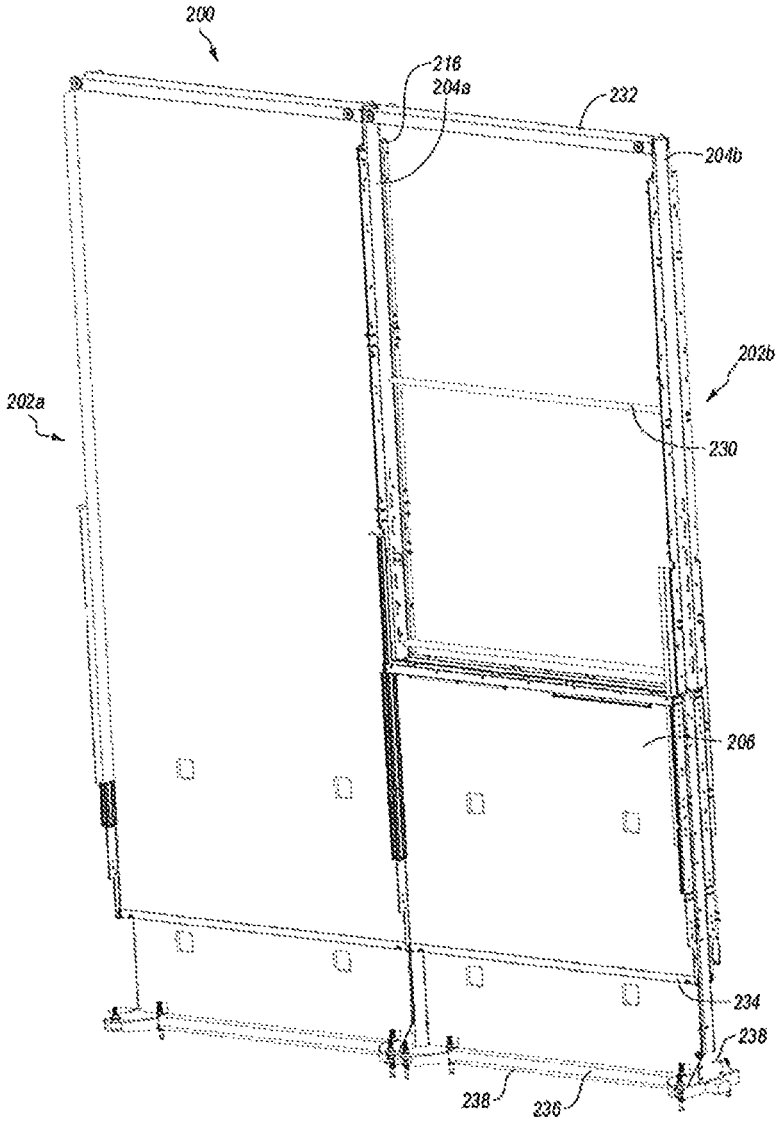
FIG. 2 illustrates two exemplary wall modules connected to form a modular wall.

FIG. 2 illustrates a partially assembled modular wall 200 in which a first wall module 202*a* has been attached to a second wall module 202*b* with one or more fasteners 216. First and second wall modules 202*a* and 202*b* may be similar or identical to wall module 100 of FIG. 1. As illustrated, wall modules 202*a* and 202*b* are coupled at terminal ends and aligned at a 180 degree angle such that wall module 202*b* constitutes an extension of wall module 202*a* in a same plane. One will appreciate, however, that wall modules 202*a* and 202*b* may be positioned at other angles without departing from the scope of this disclosure.

In some implementations, each of wall modules 202*a* and 202*b* of modular wall 200 include a first vertical bracket 204*a* and a second vertical bracket 204*b* separated by a distance. In other implementations, however, one or both of wall modules 202*a* and 202*b* may include a single vertical bracket or more than two vertical brackets. In at least one implementation, wall modules 202*a* and 202*b* share at least one common vertical bracket (e.g., as shown in FIG. 2). In the illustrated implementation, horizontal support members 230 are connected between the first and second vertical brackets 204*a* and 204*b*. As discussed above, the horizontal support members 230 may be used to provide structural support to the frames 202*a* and 202*b*. The horizontal supports 230 may also provide a connection point to which an exterior wall element or tile may be connected.

For example, in the illustrated implementation of FIG. 2, the second vertical bracket 204*a* of wall module 202*a* is, itself, the first vertical bracket 204*a* of wall module 202*b*. In some implementations, vertical bracket 204*a* comprises two vertical brackets coupled together, a first vertical bracket comprising a frame member of wall module 202*a* and a second vertical bracket comprising a frame member of wall module 202*b*. These adjoining vertical brackets may be connected together with one or more fasteners 216 or other suitable mechanisms.

According to some implementations, modular wall 200 may include an upper support element 232 and/or a lower support element 234 configured to at least partially secure wall module 202*b* and/or vertical brackets 204*a* and 204*b* in a pre-determined or other configuration. Thus, wall module 202*b* according to some implementations may include a plurality of vertical brackets separated by a plurality of support elements configured to secure the vertical brackets into a frame-like structure. One will appreciate, however, that the present disclosure is not so limited and that other configurations are contemplated herein.

As shown in FIG. 2, wall modules are typically connected end-to-end (i.e., vertical brackets on edges of the wall modules are connected together). As illustrated in FIG. 2, the vertical brackets are connected together so that the wall modules are in a 180° arrangement so that the wall modules form a continuous, generally planar wall. In other implementations, the vertical brackets can be connected together so that the wall modules are oriented at other angles (e.g., 90°) relative to one another. Regardless of the angle formed between the wall modules, previous wall systems have required the wall modules to be connected end-to-end. At times, however, it may be desirable to connect one wall module to another wall module without connecting the wall modules end-to-end.

Figure 3:
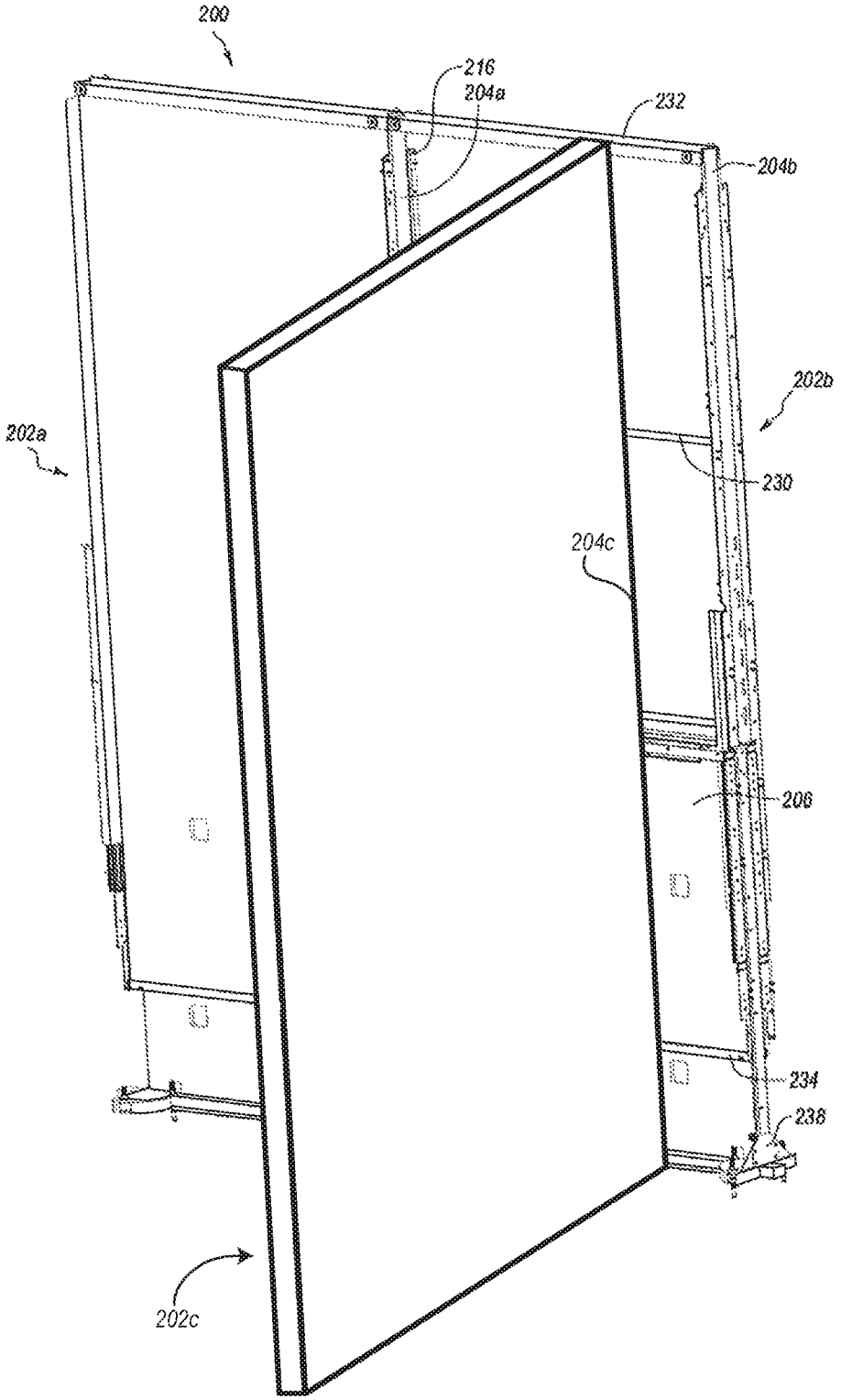
FIG. 3 illustrates the modular wall of FIG. 2 with another wall module connected thereto at a position other than at the corresponding ends of the wall modules comprising the modular wall of FIG. 2.

For instance, as illustrated in FIG. 3, it may be desirable to connect a wall module 202*c* to another wall module 202*b* at a location between vertical brackets 204*a* and 204*b* of wall module 202*b*. For instance, if modular wall 200 is too long to form a wall of a desired space, the wall module 202*c* can be connected thereto at a desired location so that the length of modular wall 200 on one side of wall module 202*c* is the desired length. The portion of modular wall 200 on the other side of wall module 202*c* may form at least part of a wall for another space.

Figure 4:
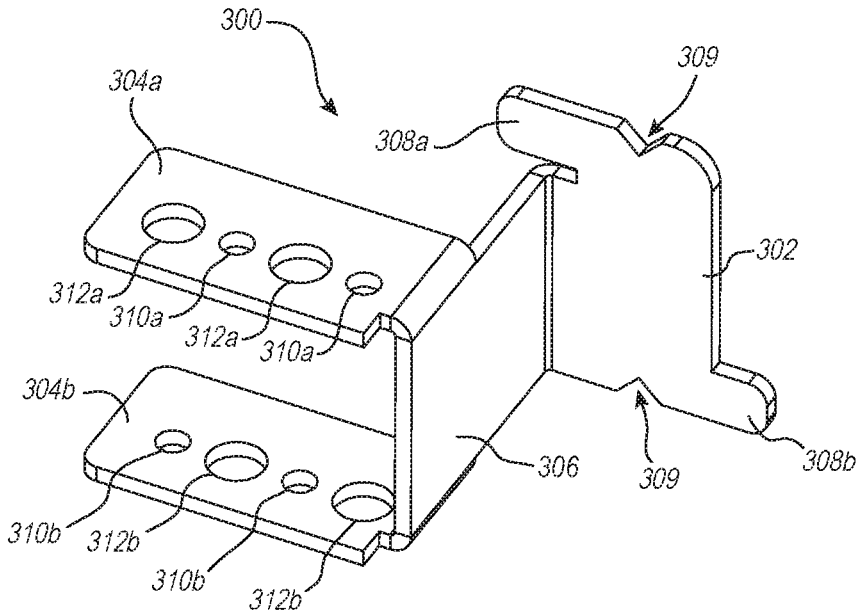
FIG. 4 illustrates a modular wall connector bracket in accordance with an implementation of the present disclosure.
Figure 5:
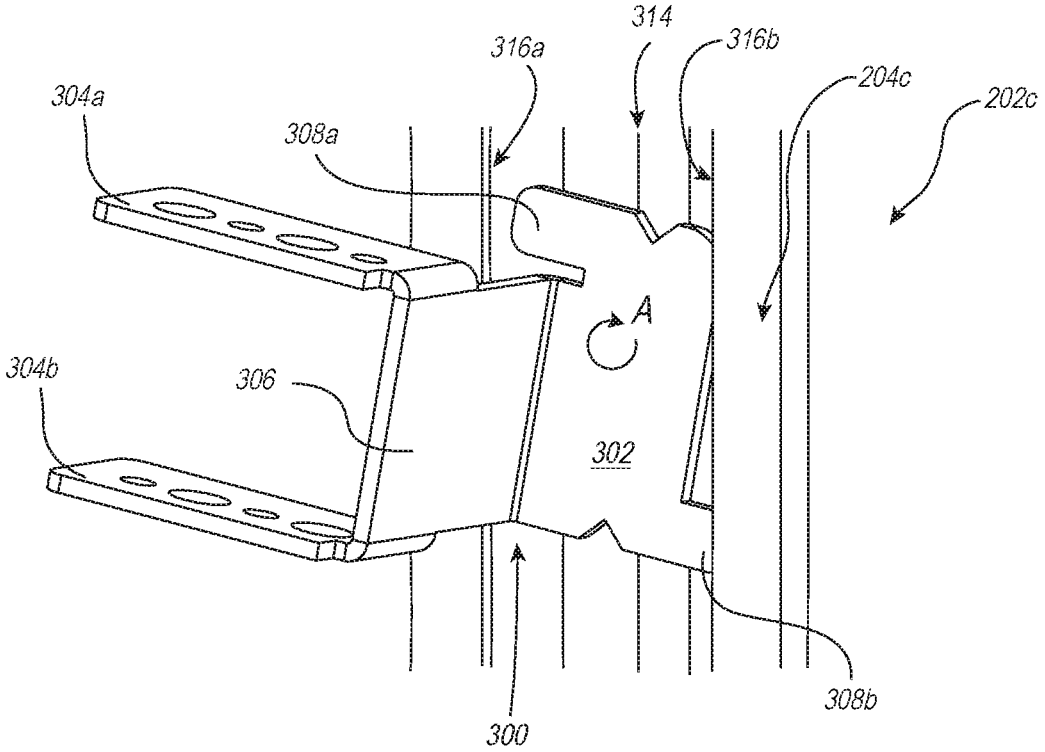
FIGS. 5 and 6 illustrate configurations of the connector bracket of FIG. 4 when connecting the connector bracket to a wall module.
Figure 6:
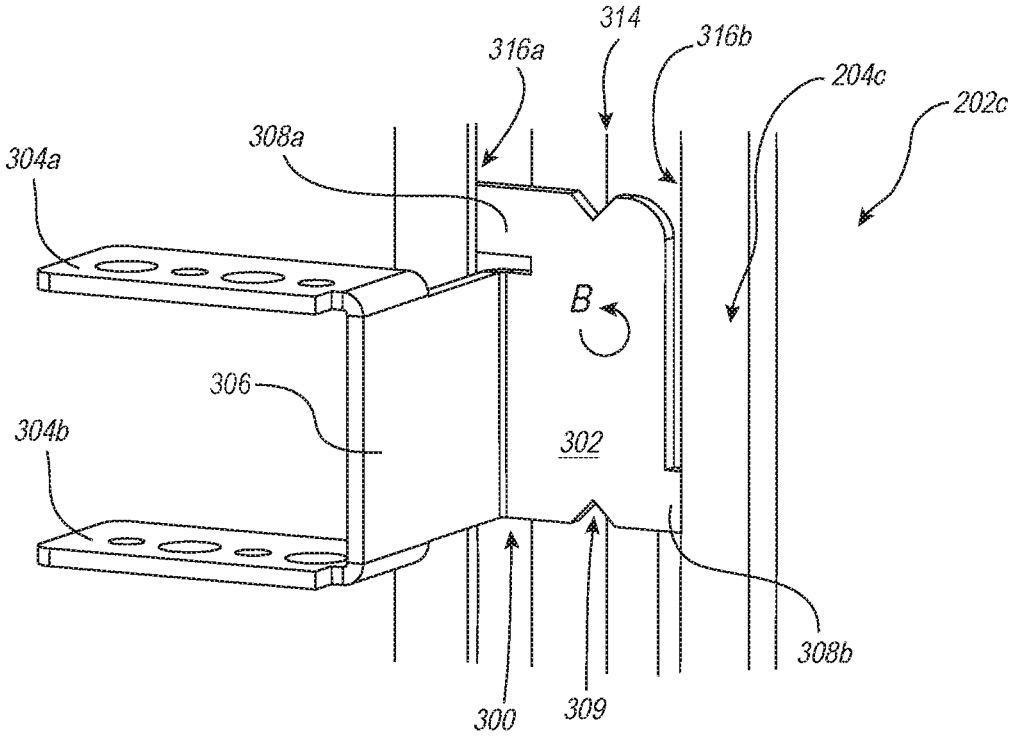

In contrast to the connection between wall modules 202*a* and 202*b* (i.e., vertical brackets connected together), wall module 202*c* is not connected to a vertical bracket of wall module 202*b*. Rather, a vertical bracket 204*c* of wall module 202*c* is connected to one or more of the horizontal support members 230 of wall module 202*b*. It should be appreciated that although FIG. 3 illustrates the wall module 202*c* being connected to a single horizontal support member 230, the wall module 202*c* can additionally, or alternatively, be connected to multiple horizontal support members and/or to one or both horizontal brackets 232, 234 comprising the top and bottom portions of the frame of wall module 202*b*. A connector bracket can be used at each of the one or more attachment sites between wall module 202*c* and 202*b*. FIGS. 4-6 illustrate a connector bracket 300 and an exemplary method of attaching the connector bracket to a wall module so that it can be used to connect wall module 202*c* to another wall module at a position between the vertical brackets thereof.

Generally, a connector bracket includes a first connector plate and one or more second connector plates, which may be connected to each other by a transition plate. The first connector plate is configured to associate the connector bracket with a first wall module and the one or more second connector plates are configured to associate the connector bracket with a second wall module, particularly a horizontal support member and/or a horizontal bracket thereof.

Referring now to FIG. 4, an exemplary connector bracket 300 is illustrated. The connector bracket 300 includes a first connector plate 302 and two second connector plates 304*a*, 304*b*. A first, second connector plate 304*a* is disposed parallel to a second, second connector plate 304*b* and spaced a distance apart from the second, second connector plate 304*b*. The first connector plate 302 and the two second connector plates 304*a*, 304*b* are connected together by a transition plate 306. The first connector plate 302 is configured to be connected to a vertical bracket of a wall module (e.g., the vertical bracket 204*c* of wall module 202*c*), and each of the two connector plates 304*a*, 304*b* are configured to be connected to one or more horizontal support members of another wall module (e.g., wall module 202*b*).

In the illustrated implementation of FIG. 4, the first connector plate 302 lies in a first plane and the transition plate 306 lies in a second plane. The first and second planes are illustrated as being orthogonal to one another (i.e., the first and second planes meet at a 90° angle). As shown, the first support plate 302 and the transition plate 306 are integrally formed. That is, the first support plate 302 and the transition plate 306 are two faces of a continuous object that has been bent or otherwise manipulated to form orthogonally oriented surfaces. However, in other implementations, the first support plate and the transition plate may be formed separately and connected together (e.g., by welding, soldering, etc.).

With continued reference to FIG. 4, the two connector plates 304*a*, 304*b* extend away from the transition plate 306 on a side opposite to the side at which the first connector plate 302 extends away from the transition plate 306. As shown, the first connector plate 302 and the second connector plates 304*a*, 304*b* extend away from the transition plate 306 in generally opposite directions. In other implementations, however, the one or more second connector plates and the first connector plate extend away from the same side of the transition plate and/or in the same direction with the resulting connector bracket being functionally analogous to the connector bracket 300 depicted in FIG. 4 and operable to connect two wall modules in the same or similar orientation as depicted in FIG. 3.

In some implementations, and as depicted in FIG. 4, each of the second connector plates 304*a*, 304*b* lies in a plane that is generally perpendicular to the first and second planes in which the first connector plate 302 and the transition plate 306 lie. Thus, the first connector plate 302 and the transition plate 306 are angled relative to one another in a first direction, the first connector plate 302 and the one or more second connector plates 304 are angled relative to one another in a second direction, and the second connector plates 304*a*, 304*b* and the transition plate 306 are angled relative to one another in a third direction. The foregoing respective configurations allow the connector bracket to be formed from a single continuous piece. Nevertheless, in some implementations, one or more of the first connector plate, the second connector plate, and/or the transition plate are made individually and assembled piece wise.

The first connector plate 302 of FIG. 4 is shown as additionally including tabs 308*a*, 308*b* disposed on opposing sides of the first connector plate 302. The first tab 308*a* extends from an upper left corner while the second tab 308*b* extends from a lower right corner of the first connector plate 302. As discussed in greater detail below, the tabs 308*a*, 308*b* can be used to connect the connector bracket 300 to a vertical bracket of a wall module (e.g., the vertical brackets 204*c* of wall module 202*c*). The first connector plate 302 also includes one or more alignment features 309. The alignment features 309 can assist with aligning the connector bracket 300 with the wall modules, which in turn can assist with aligning one wall module with a desired portion of another wall module.

As can also be seen in FIG. 4, each of the second connector plates 304*a*, 304*b* includes one or more openings 310*a*, 310*b* for receiving an attachment mechanism (e.g., a bolt, screw, etc.) therethrough, which acts to secure the associated second connector plate 304*a*, 304*b*, and thus the connector bracket 300, to a wall module (e.g., by securing the second connector plate 304*b* to a horizontal support member 230 wall module 202*b*). In the illustrated implementation, the connector bracket 300 includes two second connector plates 304*a*, 304*b* that are vertically offset from one another. The openings 310*a*, 310*b* in the second connector plates 304*a*, 304*b* are offset from one another such that an opening 310*a* on the first, second connector plate 304*a* is not aligned with an opening 310*b* of the second, second connector plate 304*b*. The second connector plates 304*a*, 304*b* also include one or more access openings 312*a*, 312*b* that are offset from one another such that an access opening 312*a* on the first, second connector plate 304*a* is not aligned with an access opening 312*b* of the second, second connector plate 304*b*. Instead, and as depicted in FIG. 4, an access opening 312 from one of the second connector plates 304 can be aligned with an opening 310 in the other of the second connector plates 304. Such alignment can allow for a tool (e.g., screwdriver, drill bit, etc.) to extend through the access opening 312 and engage a fastener to drive the fastener into the corresponding opening 310. In some implementations, the opening-access opening pairs can be staggered or stacked along the surface of the second connector plate to allow for a plurality of different locations for securing the second connector plate—and thereby the connector bracket and associated wall module—to a horizontal support member and/or horizontal bracket.

It should be appreciated that the alignment of opening 310*a* on a first, second connector plate 304*a* with access opening 312*b* on the second, second connector plate 304*b* allows a tool to span the second connector plate and access an attachment element disposed within opening 310*a*. This allows the first, second connector plate to be attached to a horizontal support member. Similarly, the alignment of opening 310*b* on a second, second connector plate 304*b* with an access opening 312*a* on the first, second connector plate allows a tool to span the second connector plate and access an attachment element disposed within opening 310*b*. This allows the second, second connector plate 304*b* to be secured to a horizontal support member.

FIGS. 5 and 6 illustrate one exemplary method for installing the connector bracket 300 into a vertical bracket 204*c* of a wall module 202*c*. As shown in FIG. 5, the connector bracket 300 can be tilted or rotated (e.g., as illustrated by arrow A) so it can be inserted into a channel 314 in the vertical bracket 104. Referring now to FIG. 6, after being inserted into the channel 314, the connector bracket 300 can be tilted or rotated (e.g., in the opposite direction of arrow A in FIG. 5 or as illustrated by arrow B in FIG. 6) so that the tabs 308*a*, 308*b* are disposed behind retention elements 316*a*, 316*b*, respectively. The alignment feature 309 can be used as a reference point to determine whether the connection bracket is properly aligned within the channel 314. For example, the channel 314 can include a central line or groove that aligns with the alignment features 309 when the connection bracket is properly aligned within the channel 314. Additionally, or alternatively, alignment features 309 can be disposed at a top and bottom side of the first connection plate and can be used to gauge alignment of the connection bracket (e.g., by aligning the alignment features using a level).

FIG. 6 illustrates the connector bracket 300 mounted to the vertical bracket 204*c* with the tabs 308*a*, 308*b* held in the channel 314 by the retention elements 316*a*, 316*b*. The retention elements 316*a*, 316*b* can prevent the connector bracket 300 from being inadvertently withdrawn from the channel 314. In some implementations, the retention elements are metered or have ridges or other elements that interact with the tabs on the connector bracket, allowing the connector bracket to be secured at defined positions along the channel. In some implementations, the connector bracket can slide through the channel to selectively reposition the connector bracket relative to the vertical bracket.

Figure 7:
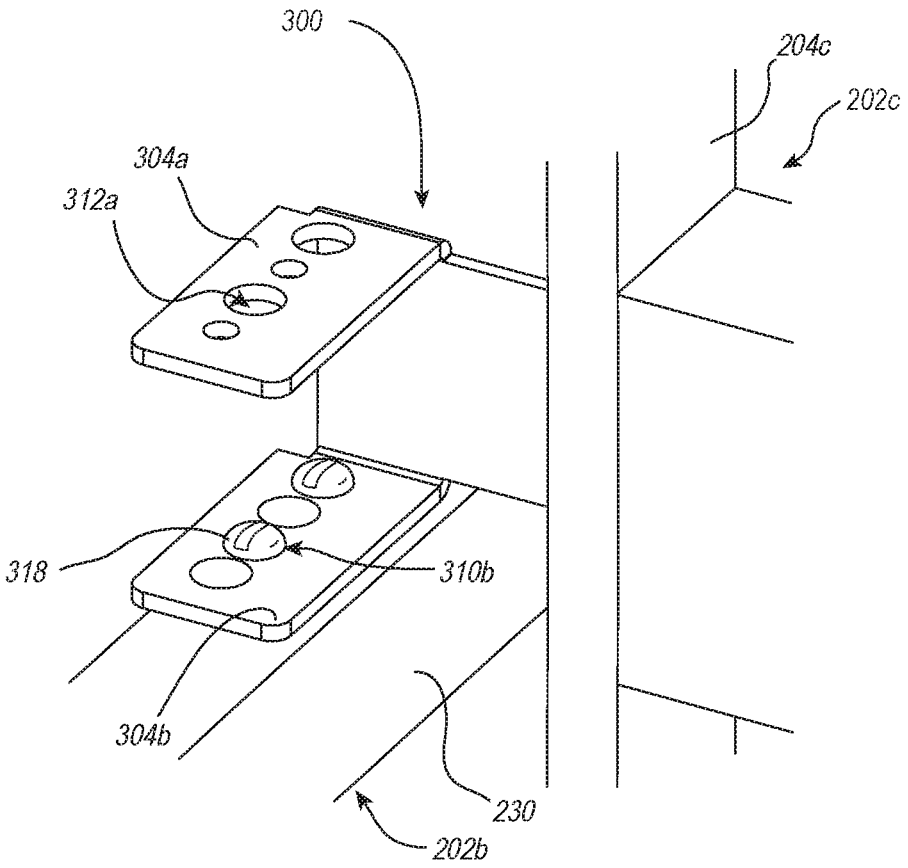
FIG. 7 illustrates a wall module connected to another wall module via a modular wall connector bracket.

As noted above, the connector bracket 300 can be connected to a horizontal support member in order to connect two wall modules together. As shown in FIG. 7, for example, the connector bracket 300 is connected to a vertical bracket 204*c* of wall module 202*c* and to a horizontal support member 230 of wall module 202*b*. In the illustrated implementation, the connector bracket 300 is connected to a top of the horizontal support member 230 using fasteners 318. As can be seen, fasteners 318 extend through opening 310*b* in the second, second connector bracket 304*b* and into the horizontal support member 230. This secures the connection between wall module 202*c* and wall module 202*b* and enables wall module 202*c* to be connected to wall module 202*b* anywhere along the width of wall module 202*b*, not just to an end thereof (e.g., vertical brackets comprising vertical portions of the wall module frame). In other embodiments, the connector bracket 300 can be connected to a bottom of the horizontal support member 230 using fasteners similar or identical to fasteners 318. The fasteners extend through opening 312*a* in the first, second connector bracket 304*a* and into the horizontal support member 230.

In some implementations, the connector bracket is secured to a single horizontal support member or horizontal bracket. In some implementations, multiple connector brackets can be used to connect two wall modules together. In some implementations, a plurality of connector brackets can be inserted into the same channel of a vertical bracket and connected to a corresponding wall module at a plurality of corresponding horizontal support members/horizontal brackets. Using multiple connector brackets can provide additional strength and structural integrity to the connection between the two wall modules. Multiple connector brackets 300 can also prevent one of the wall modules (i.e., the wall module that receives the tabs 308*a*, 308*b* within a vertical bracket channel 314) from pivoting relative to a single connector bracket 300 and disconnecting from the connector bracket and the other wall module. Illustratively, the first wall module can be connected to the second wall module at a horizontal support member and at a horizontal bracket.

In some implementations, a single connector bracket is associated with a plurality of horizontal support members/horizontal brackets. For example, the first, second connector plate is secured to a first horizontal support member, and the second, second connector plate is secured to a second horizontal support member. In some implementations, the second connector plate is secured on one end to an upper or lower horizontal bracket and secured on the other end to a horizontal support member.

Figure 8:
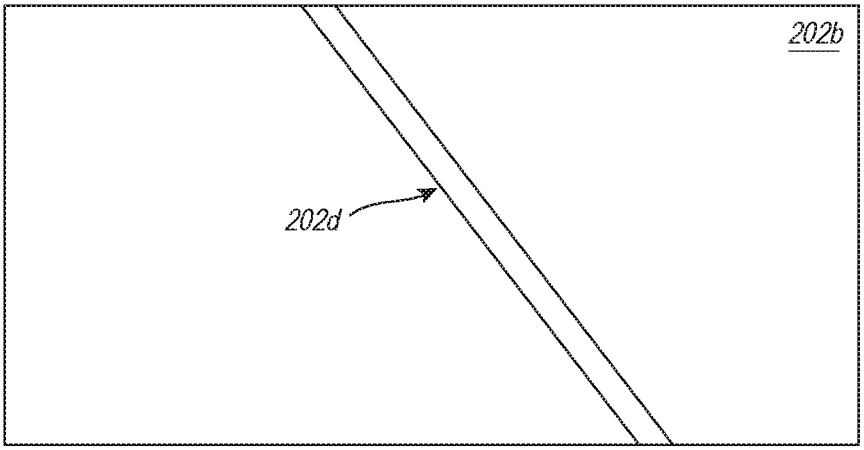
FIG. 8 illustrates a wall module connected to another wall module at a pitched vertical angle in accordance with an implementation of the present disclosure.

Connector bracket 300 has been shown and described to allow for two wall modules to be connected together at a right angle relative to one another. The present disclosure, however, is not so limited. For instance, a connector bracket may be configured to enable two wall modules to be connected together at non-right angles. For instance, FIG. 8 illustrates a first wall module 202*b* and a second wall module 202*d* that can be connected together with the second wall module 202*d* vertically oriented at an angle other than 90° relative to the first wall module 202*b*. In the illustrated implementation, the first wall module 202*b* can be a substantially vertical wall module, and the second wall module 202*d* can be an angled wall module. More specifically, the second wall module 202*d* may be vertically angled such that the top thereof may be positioned further away from a vertical support of the first wall module 202*b* than a bottom thereof.

Figure 9A:
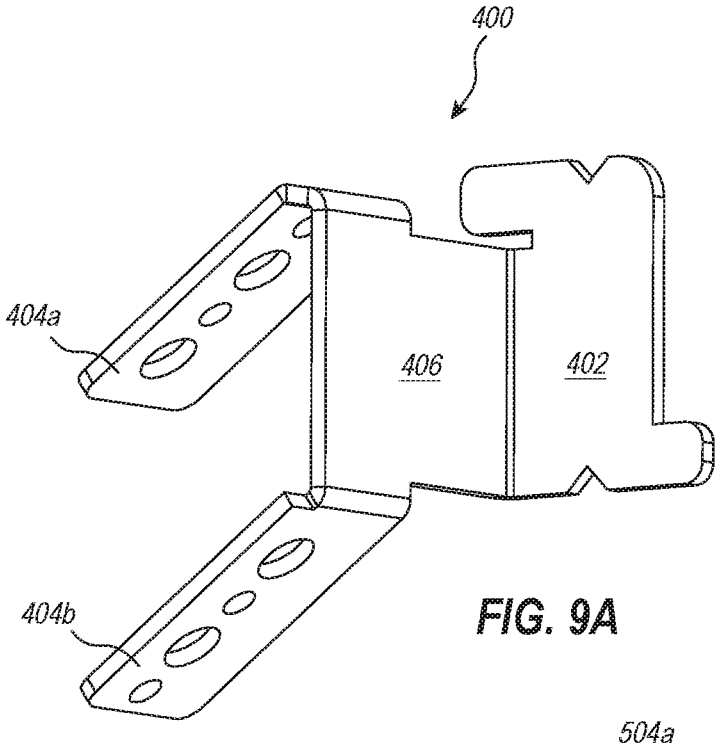
FIGS. 9A and 9B illustrate exemplary connector brackets for connecting two wall modules as shown, for example, in FIG. 8.
Figure 9B:
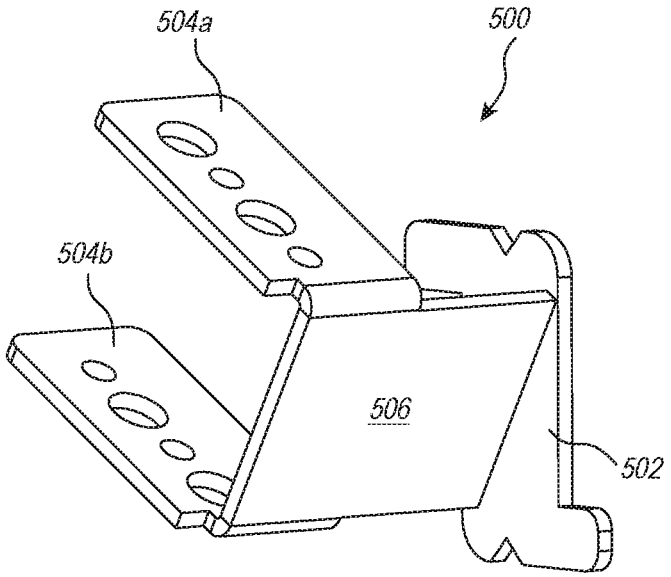

In order to connect two wall modules together at such an angle, the connector bracket may be slightly modified. For instance, rather than having the second connector plates 304*a*, 304*b* and the transition plate 306 forming a 90° angle, as shown in FIG. 4, the second connector plates 404*a*, 404*b* and the transition plate 406 may form an angle that is greater than or less than 90°, as shown in FIG. 9A. Alternatively, or additionally, the transition plate 306 may extend diagonally across a face of the first connector plate 502 rather than extending along an edge thereof, as shown in FIG. 9B. Such modifications may alter the orientation of the first connector plate and the one or more second connector plates, which would allow for two wall modules to be connected together with one of the wall modules being vertically angled relative to the other (as shown in FIG. 8.

Figure 10:
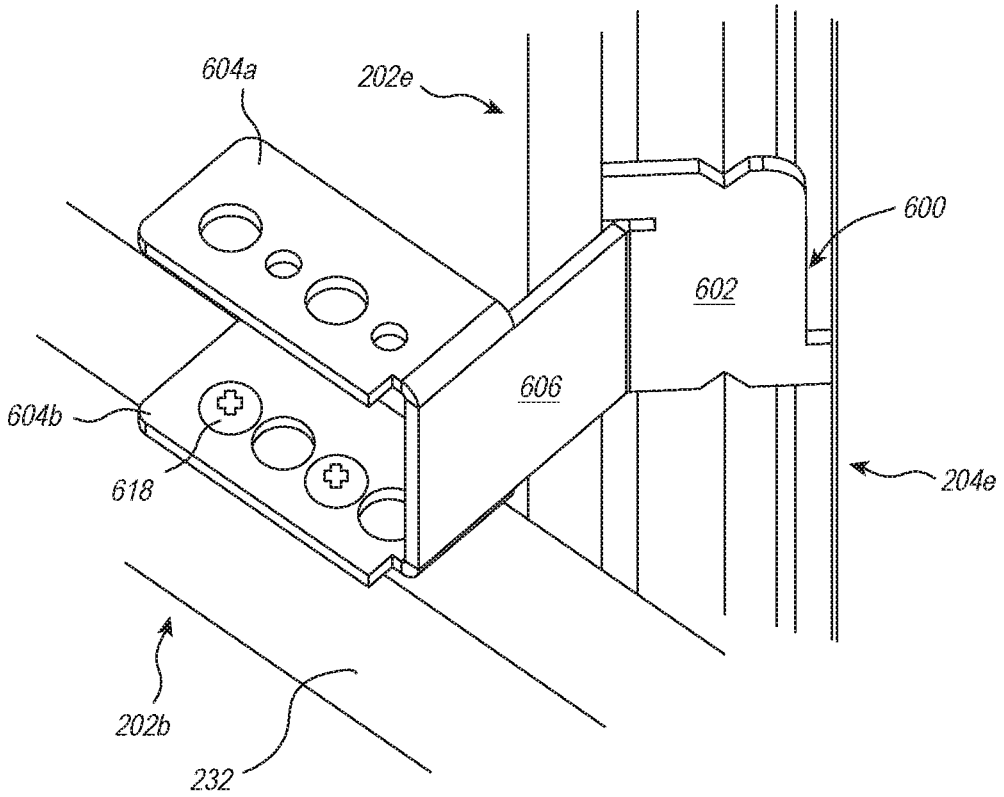
FIG. 10 illustrates a connector bracket connecting two wall modules together at a non-right angle in accordance with another implementation of the present disclosure.
Figure 11:
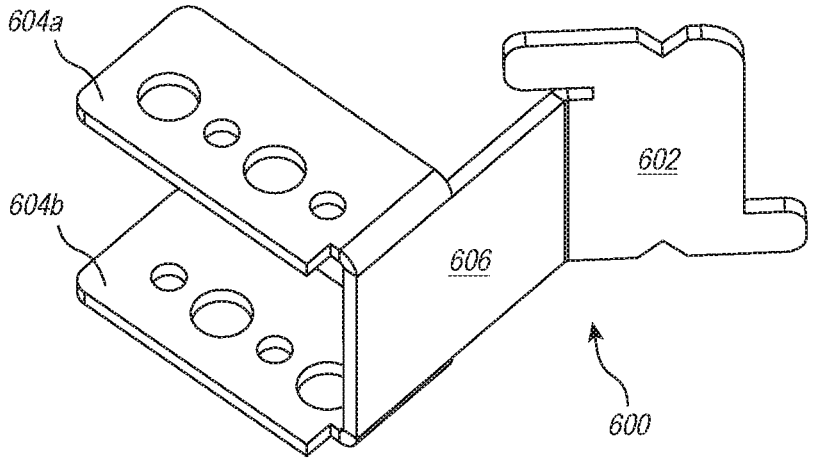
FIG. 11 illustrates an exemplary connector bracket for connecting two wall modules at non-right angles as shown, for example, in FIG. 10.

The connector bracket may also be modified to enable two wall modules to be connected together such that one of the wall modules extends away from the other wall module at an angle other than 90°. For example, FIG. 10 illustrate components of a first and second wall modules 202*b* and 202*e* connected together with a modified connector bracket 600, and FIG. 11 illustrates the connector bracket 600 of FIG. 10 alone. As can be seen, wall module 202*e* extends away from wall module 202*b* at an obtuse angle. This can be accomplished by changing the relative orientation between the first connector plate 602 and the transition plate 606, as shown in FIGS. 10 and 11. In contrast to the connector bracket 300 shown in FIGS. 4-6, in which the first connector plate 302 and the transition plate 306 form a 90° angle, the first connector plate 602 and the transition plate 606 shown in FIGS. 10 and 11 form an obtuse angle. In other implementations, the first connector plate and the transition plate can form an acute angle.

In addition or as an alternative to changing the angle between the first connector plate and the transition plate (as shown in FIGS. 10 and 11), the orientation of the second connector plate(s) may be adjusted relative to the first connector plate and/or the transition plate. For instance, rather than extending generally parallel to one another as shown in FIG. 4, the first connector plate and the second connector plates may extend away from one another in non-parallel directions. Similarly, rather than extending away from the transition plate in a direction generally normal to a surface thereof, the second connector plates may extend away from the transition plate at an acute or obtuse angle.

Regardless of the orientation or angle at which the wall modules are connected together, the connector bracket may maintain the orientation of the wall modules relative to one another. Additionally, once the wall modules are connected together with the connector bracket, exterior wall elements (such as a tile or panel) may be attached to the wall modules to provide a finished look to the assembled modular wall. In some implementations, the exterior wall elements can cover at least portions of the connector bracket and/or the joint between the two wall modules. In other implementations, particularly where one of the wall modules extends away from the other at a non-right angle, additional trim components may be used to cover the connector bracket and/or the joint between the two wall modules, or the exterior wall element can be custom made to cover the wall module.

It is noted that a wall, wall module, or modular wall, according to an implementation of the present invention may include, incorporate, or otherwise comprise properties, features, components, members, and/or elements described in other implementations, including systems, methods, products, devices, and/or implementations of the same disclosed herein. Thus, reference to a specific feature in relation to one implementation should not be construed as being limited to applications within said implementation.

The present invention may be embodied and/or implemented in other specific forms without departing from its spirit or essential characteristics. The described implementations are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. A connector bracket for use in connecting two wall modules together, comprising:

a first connector plate having first and second tabs extending therefrom that are configured to attach to a vertical bracket of a first wall module;

one or more second connector plates configured to be attached to one or more horizontal support members of a second wall module; and a transition plate connected between the first connector plate and the one or more second connector plates, wherein the first tab and the one or more second connector plates extend at least partially in the same direction, and wherein the second tab and the one or more second connector plates extend at least partially in opposite directions.

2. The connector bracket of claim 1, wherein the first connector plate and the one or more second connector plates extend from the transition plate in opposite directions.

3. The connector bracket of claim 1, wherein the two tabs extend in opposing directions.

4. The connector bracket of claim 3, wherein the two tabs extend from diagonally opposing quadrants of the first connector plate.

5. The connector bracket of claim 1, wherein the first connector plate and the transition plate are oriented at a 90° angle relative to one another.

6. The connector bracket of claim 1, wherein the one or more second connector plates and the transition plate are oriented at a 90° angle relative to one another.

7. The connector bracket of claim 1, wherein the one or more second connector plates comprise a first second connector plate and a second second connector plate.

8. The connector bracket of claim 7, wherein each of the first second connector plate and the second second connector plates comprises one or more attachment openings configured to receive a fastener.

9. The connector bracket of claim 8, wherein the one or more attachment openings in the first second connector plate are offset from the one or more attachment openings in the second second connector plate.

10. The connector bracket of claim 8, wherein each of the first second connector plate and the second second connector plate comprises one or more access openings.

11. The connector bracket of claim 10, wherein the one or more access openings in the first second connector plate are offset from the one or more access openings in the second second connector plate.

12. The connector bracket of claim 10, wherein at least one of the access openings in the first second connector plates is aligned with an attachment opening in the second second connector plate.

13. The connector bracket of claim 1, wherein the transition plate extends from the first connector plate at a non-right angle.

14. The connector bracket of claim 1, wherein the one or more second connector plates are parallel to one another and extend from the transition plate at a non-right angle.

15. A modular wall system, comprising:

a first wall module comprising one or more vertical brackets and one or more horizontal support members connected to the one or more vertical brackets, wherein at least one of the one or more vertical brackets comprises a channel therein;

a second wall module comprising one or more vertical brackets and one or more horizontal support members connected to the one or more vertical brackets; and a connector bracket configured to connect the first wall module and the second wall module together, the connector bracket comprising:

a first connector plate having two tabs extending in opposing directions from diagonally opposing quadrants of the first connector plate, the two tabs being configured to be received within the channel of the at least one of the one or more vertical brackets of the first wall module and to engage opposing sides of the channel, and one or more second connector plates configured to be attached to the one or more horizontal support members of the second wall module.

16. The modular wall system of claim 15, wherein the connector bracket further comprises a transition plate connected between the first connector plate and the one or more second connector plates.

17. The modular wall system of claim 16, wherein the first connector plate and the one or more second connector plates extend from the transition plate in opposite directions.

18. The modular wall system of claim 16, wherein the first connector plate and the transition plate are oriented at a 90° angle relative to one another.

19. The modular wall system of claim 16, wherein the one or more connector plates and the transition plate are oriented at a 90° angle relative to one another.

20. The modular wall system of claim 15, wherein the one or more second connector plates comprise two second connector plates.

* * * * *